US012465112B1

(12) United States Patent
Newton et al.

(10) Patent No.: US 12,465,112 B1
(45) Date of Patent: Nov. 11, 2025

(54) VACUUM RELEASE MECHANISM FOR A FOOTWEAR ARTICLE

(71) Applicant: Thomas Wayne Newton, Miami, FL (US)

(72) Inventors: Thomas Wayne Newton, Miami, FL (US); Lisa Fitzgerald, Leesburg, FL (US)

(73) Assignee: Thomas Wayne Newton, Miami, FL (US)

( * ) Notice: Subject to any disclaimer, the term of this patent is extended or adjusted under 35 U.S.C. 154(b) by 0 days.

(21) Appl. No.: 18/659,543

(22) Filed: May 9, 2024

(51) Int. Cl.
*A43B 7/08* (2022.01)
*A43B 7/083* (2022.01)
*A43B 7/12* (2006.01)

(52) U.S. Cl.
CPC ..... *A43B 7/083* (2022.01); *A43B 7/087* (2013.01); *A43B 7/088* (2013.01); *A43B 7/12* (2013.01)

(58) Field of Classification Search
CPC .. A43B 7/06; A43B 7/08; A43B 7/082; A43B 7/083; A43B 7/084; A43B 7/087; A43B 7/088; A43B 7/12
See application file for complete search history.

(56) References Cited

U.S. PATENT DOCUMENTS

| | | | | |
|---|---|---|---|---|
| 2,402,334 | A | 6/1946 | Marks | |
| 2,548,753 | A | 4/1951 | Gustaf | |
| 2,708,320 | A | 5/1955 | Hilton | |
| 3,339,298 | A | 9/1967 | Kesselman | |
| 4,888,887 | A | 12/1989 | Solow | |
| 5,375,345 | A | 12/1994 | Djuric | |
| 2004/0163278 | A1 | 8/2004 | Caspers et al. | |
| 2005/0183290 | A1 | 8/2005 | Cantrell | |
| 2006/0059722 | A1 | 3/2006 | Jarriel | |
| 2016/0058125 | A1 | 3/2016 | Martin, Sr. | |
| 2016/0192728 | A1* | 7/2016 | Crawford | A43B 3/26 36/45 |
| 2018/0199662 | A1* | 7/2018 | Meacock | A43B 7/085 |
| 2023/0210217 | A1* | 7/2023 | Sherlock | A43B 5/08 36/25 R |

FOREIGN PATENT DOCUMENTS

| | | | |
|---|---|---|---|
| CN | 2227429 | Y | 5/1996 |
| CN | 101862047 | A | 10/2010 |

* cited by examiner

*Primary Examiner* — Sharon M Prange

(74) *Attorney, Agent, or Firm* — Shumaker, Loop & Kendrick, LLP

(57) ABSTRACT

A footwear article having a vacuum release mechanism is disclosed. The vacuum release mechanism equalizes pressure to release a vacuum created beneath the footwear article, thereby eliminating an undesired retention of the footwear article in high-viscosity materials such as mud or concrete. The vacuum release mechanism includes at least one check valve disposed in at least one fluid passageway formed in a sole of a footwear article. The at least one fluid passageway fluidly connects an exterior environment with an interior of the footwear article.

17 Claims, 7 Drawing Sheets

VACUUM RELEASE MECHANISM FOR A FOOTWEAR ARTICLE

FIELD

The present invention relates generally to the field of footwear, and more particularly to a vacuum release mechanism for a footwear article such as work, hiking and military style footwear for wet service.

BACKGROUND

When wearing boots in wet areas often these conditions can create a high viscosity mixture of soil or man-made mixtures such as concrete. This can cause the boot to become extremely hard or impossible to pull out when stepping into these mixtures. This is caused by vacuum created on the sole of the boot as the user tries to lift their feet. This will cause a lack of mobility, is annoying and in some circumstances can be dangerous. A construction worker may not be able to avoid moving equipment or a soldier may not be able to find cover from gun fire in time to avoid harm.

SUMMARY

In concordance and agreement with the present disclosure, a vacuum release mechanism for a footwear article, has surprisingly been designed.

A need exists to provide footwear, for example boots, which can minimize and/or eliminate vacuum thereby preventing the footwear from becoming stuck when walking or working in high viscosity materials. The addition of one or more check valves placed in the footwear relieves this vacuum. The check valves allow higher atmospheric pressure to equalize pressure between the top of the footwear and vacuum on the sole of the footwear. This destroys the vacuum that sticks the footwear in the viscous fluid. When the footwear is worn in low viscosity areas such as water, the check valves keep water or other low viscosity liquids from entering the footwear.

In one embodiment, a vacuum release mechanism for a footwear article, comprises: at least one check valve disposed in at least one fluid passageway formed in a sole of a footwear article, wherein the at least one fluid passageway fluidly connects an exterior environment with an interior of the footwear article.

In another embodiment, a footwear article, comprises: a sole including an insole and an outsole; an upper coupled to the sole, wherein the insole and the upper defines an interior of the footwear article; and a vacuum release mechanism disposed in the sole, the vacuum release mechanism comprising: at least one check valve disposed in at least one fluid passageway formed in the sole of the footwear article, wherein the at least one fluid passageway fluidly connects an exterior environment with the interior of the footwear article.

As aspects of some embodiments, the footwear article forms part of a waterproof garment.

As aspects of some embodiments, the at least one fluid passageway is fluidly connected to a tube having an end open to the exterior environment.

As aspects of some embodiments, an entirety of the at least one fluid passageway is formed in the sole of the footwear article.

As aspects of some embodiments, the at least one fluid passageway is formed at an angle through the sole of the footwear article.

As aspects of some embodiments, a plurality of check valves is disposed in a plurality of fluid passageways formed in the sole of the footwear article, and wherein each of the fluid passageways is separate and fluidly disconnected from one another.

As aspects of some embodiments, a plurality of check valves is disposed in a plurality of fluid passageways formed in the sole of the footwear article, and wherein at least two of the fluid passageways are fluidly connected to one another.

As aspects of some embodiments, the at least one fluid passageway forms a linear flow path through the sole of the footwear article.

As aspects of some embodiments, an end opening of the at least one fluid passageway is formed in a face of a heel of the footwear article.

As aspects of some embodiments, an end opening of the at least one fluid passageway is at an angle to an outsole of the footwear article.

As aspects of some embodiments, an end opening of the at least fluid passageway is oblique to an outsole of the footwear article.

As aspects of some embodiments, an end opening of the at least one fluid passage way is relatively coplanar with an interior surface of an insole of the footwear article.

As aspects of some embodiments, the at least one check valve in a first position militates against a flow of fluid therethrough when the footwear article is unrestrained, and wherein the at least one check valve in a second position permits the flow of fluid therethrough when the footwear article is restrained by a vacuum.

As aspects of some embodiments, the at least one check valve is one of a piston-type check valve, a ball-type check valve, a diaphragm-type check valve, a swing-type check valve, a spring-type check valve, and a duckbill-type check valve.

As aspects of some embodiments, the at least one check valve is retained in the at least one fluid passageway by one of an interference fit, a threaded engagement, and at least one retaining element.

As aspects of some embodiments, a substantially fluid tight seal is formed between the at least one check valve and an inner surface of the at least one fluid passageway.

As aspects of some embodiments, the sole of the footwear article is produced from a self-sealing material that forms a substantially fluid-tight seal between the at least one check valve and an inner surface of the at least one fluid passageway.

As aspects of some embodiments, the vacuum release mechanism further comprises a sealing element to form a substantially fluid-tight seal between the at least one check valve and an inner surface of the at least one fluid passageway.

As aspects of some embodiments, the check valve is replaceable.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

DETAILED DESCRIPTION

Figure 1:
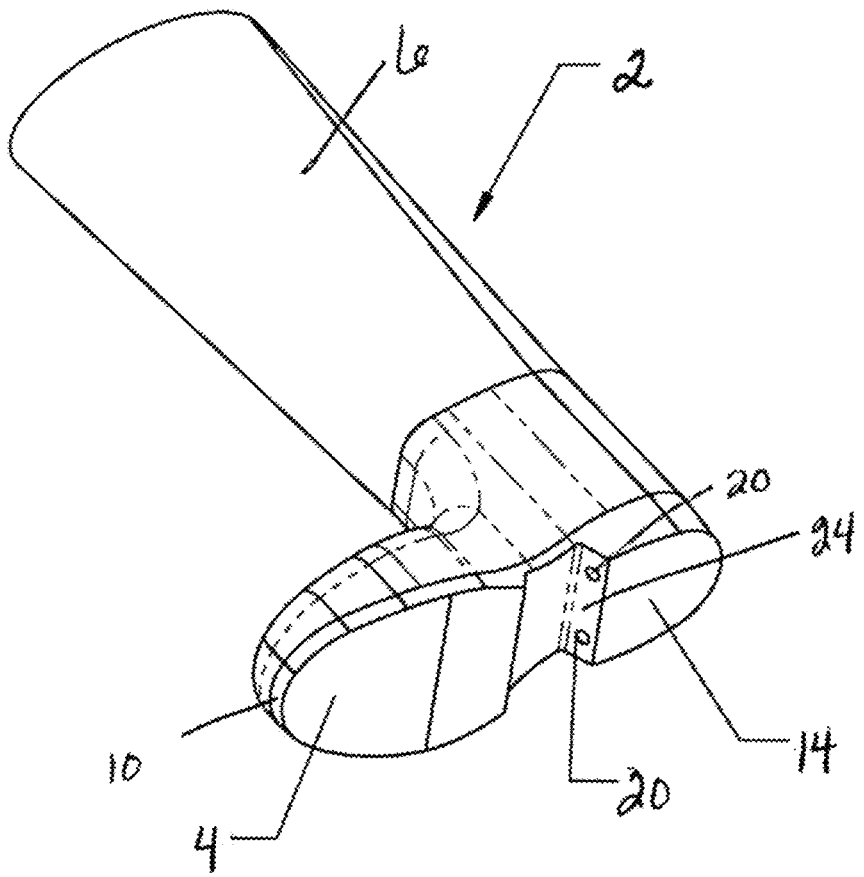
FIG. 1 is a side perspective view of a footwear article having a vacuum release mechanism according to an embodiment of the present disclosure.
Figure 2:
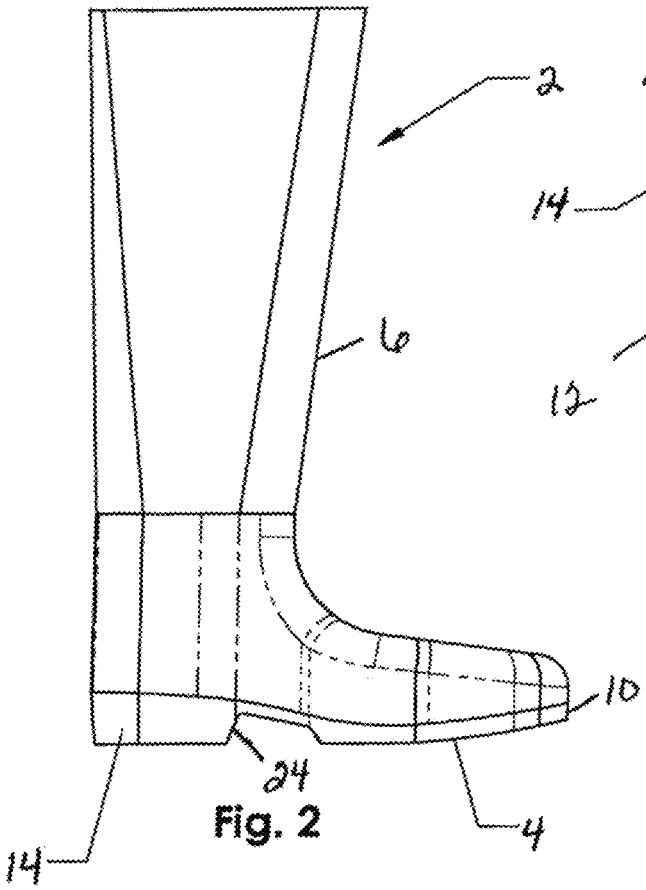
FIG. 2 is a side elevational view of the footwear article of FIG. 1.
Figure 4:
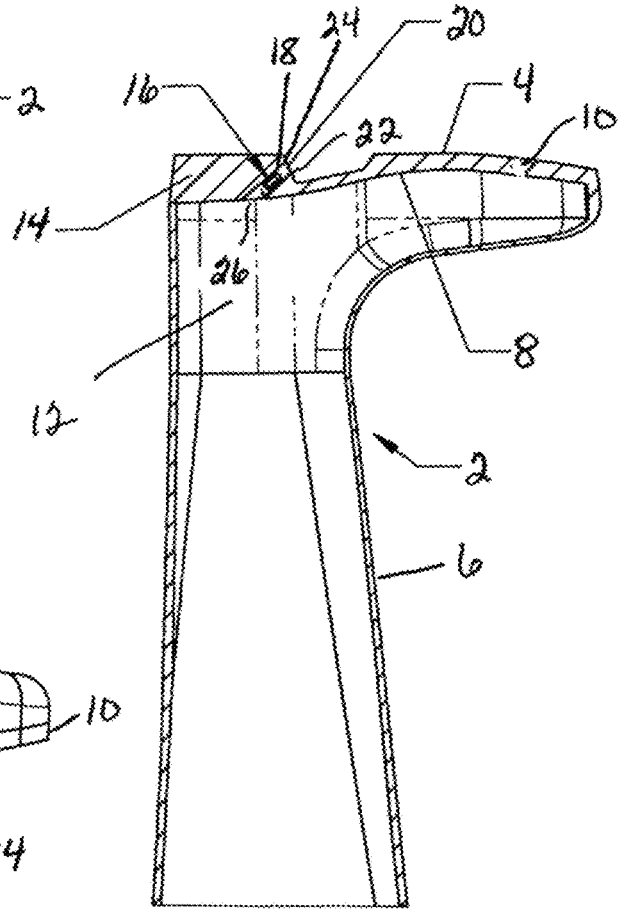
FIG. 4 is a section view of the footwear article of FIGS. 1-3 taken along section line 4-4 of FIG. 3.
Figure 3:
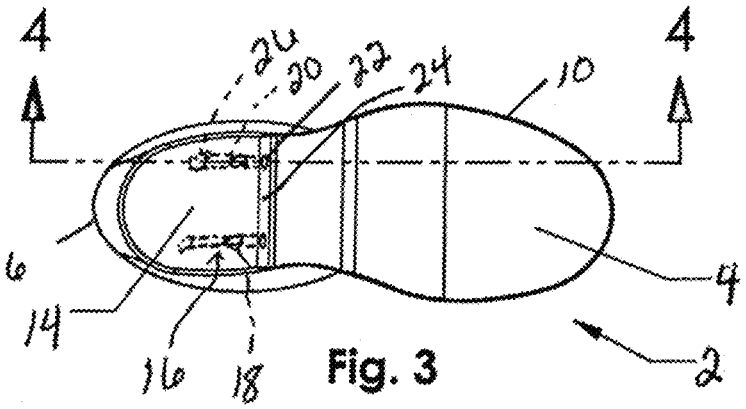
FIG. 3 is a bottom plan view of the footwear article of FIGS. 1 and 2.
Figure 5:
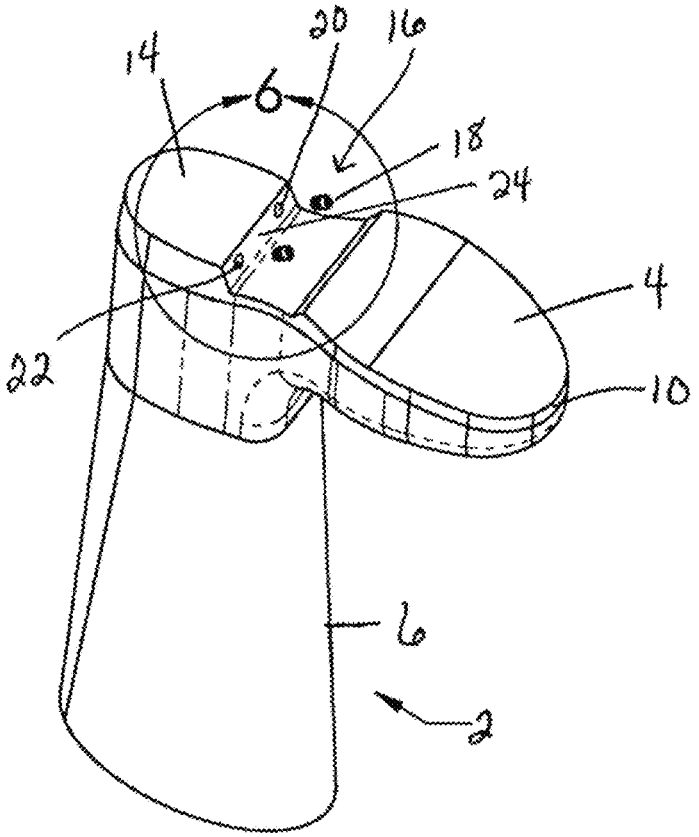
FIG. 5 is a partially exploded bottom perspective view of the footwear article of FIGS. 1-4.
Figure 6:
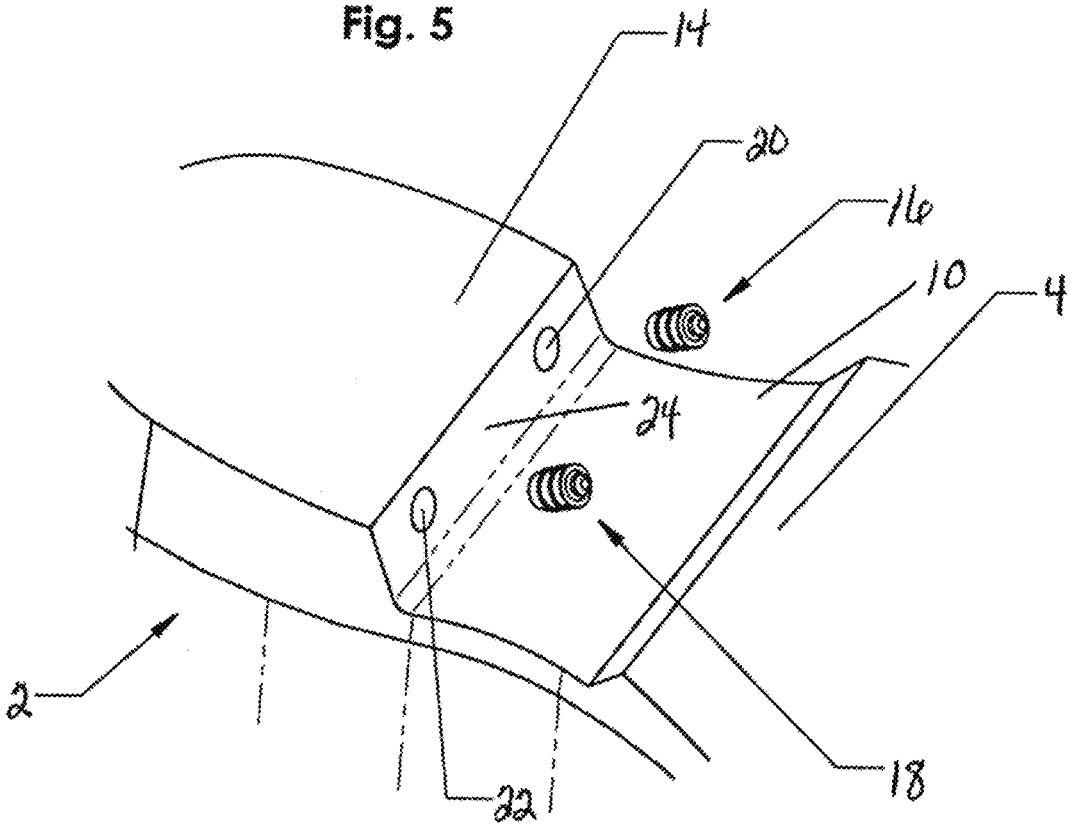
FIG. 6 is a partially exploded enlarged detailed view of a portion of the footwear article of FIGS. 1-5 depicted within Circle Area 6 of FIG. 5.
Figure 7:
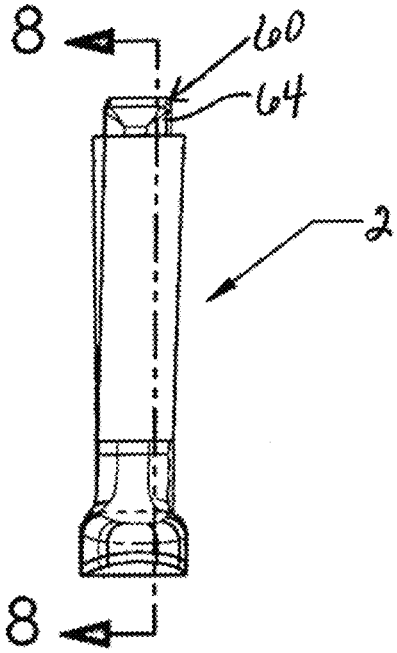
FIG. 7 is a fragmentary front elevational view of the footwear article of FIGS. 1-6, wherein a lower limb portion of a wearer is disposed in the footwear article and the lower limb portion is in a first position.
Figure 8:
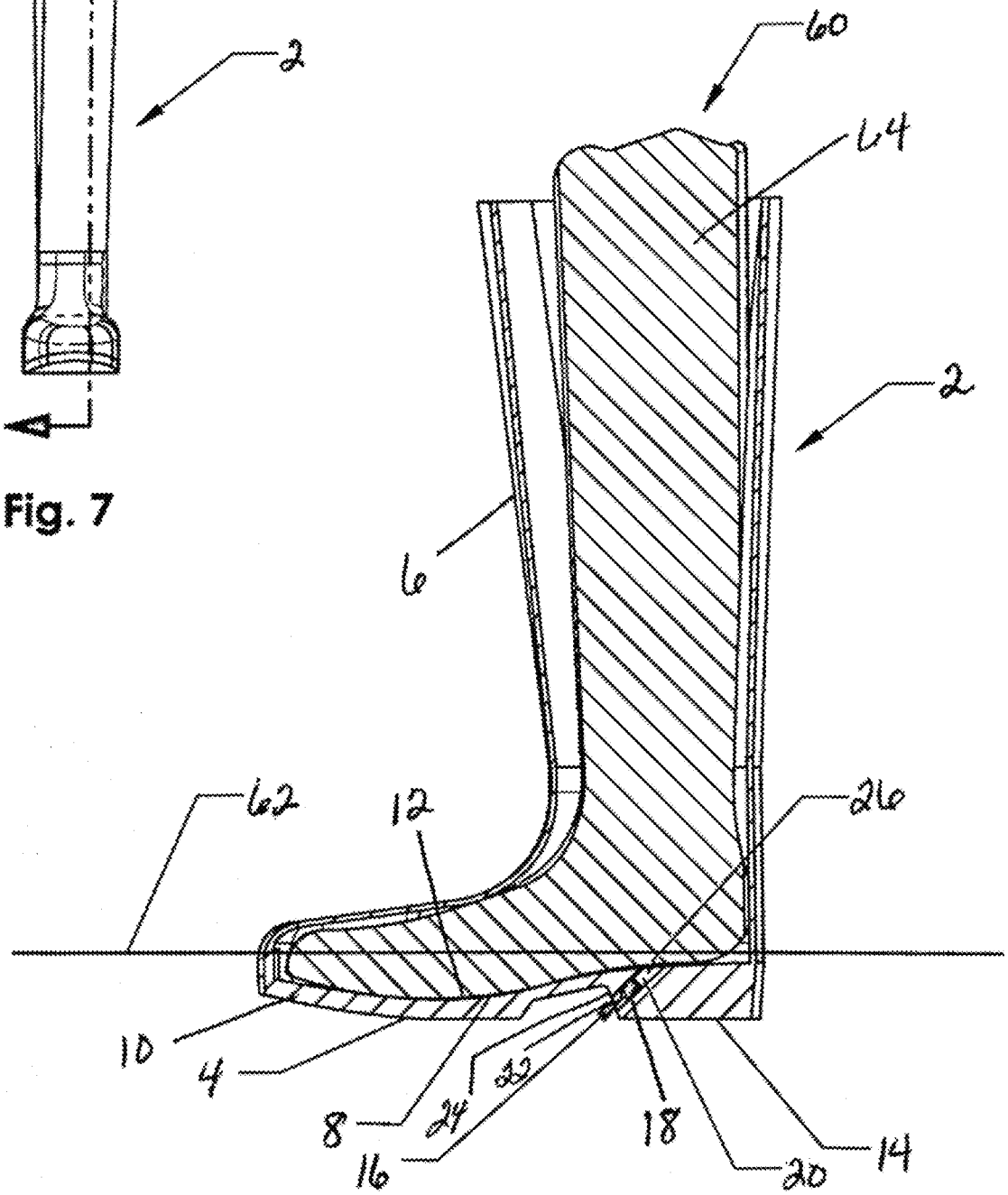
FIG. 8 is a fragmentary section view of the footwear article of FIGS. 1-7 taken along section line 8-8 of FIG. 7, wherein the lower limb portion of the wearer is disposed in the footwear article and the lower limb portion is in the first position.
Figure 9:
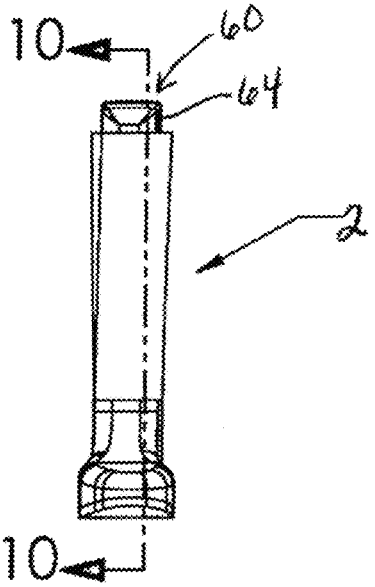
FIG. 9 is a fragmentary front elevational view of the footwear article of FIGS. 1-8, wherein a lower limb portion of a wearer is disposed in the footwear article and the lower limb portion is in a second position.
Figure 11:
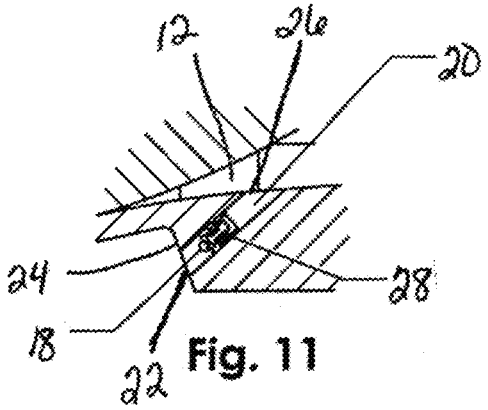
FIG. 11 is an enlarged detailed view of a portion of the footwear article of FIGS. 1-10 depicted within Circle Area 11 of FIG. 10.

The following description of technology is merely exemplary in nature of the subject matter, manufacture and use of one or more disclosures, and is not intended to limit the scope, application, or uses of any specific disclosure claimed in this application or in such other applications as may be filed claiming priority to this application, or patents issuing therefrom. Regarding methods disclosed, the order of the steps presented is exemplary in nature, and thus, the order of the steps can be different in various embodiments. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

All documents, including patents, patent applications, and scientific literature cited in this detailed description are incorporated herein by reference, unless otherwise expressly indicated. Where any conflict or ambiguity may exist between a document incorporated by reference and this detailed description, the present detailed description controls.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, all compositional percentages are by weight of the total composition, unless otherwise specified. Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

FIGS. 1-11 illustrate a vacuum release mechanism for a footwear article 2 according to an embodiment of the present disclosure. Typically, the footwear article 2 includes a sole 4 and an upper 6 coupled to the sole 4. It is understood that the sole 4 and the upper 6 may be separate and distinct components of the footwear article 2 or be integrally formed as a single unit. The sole 4 may comprise an insole 8 and an outsole 10. The upper 6 and the insole 8 may define an interior 12 of the footwear article 2. A heel 14 may also be formed on a rear portion of the sole 4 of the footwear article 2. It is understood that the heel 14 may be integrally formed with and become a part of the sole 4 of the footwear article 2. In some embodiments, the footwear article 2 may be a shoe, a boot, or any type of footwear that may be worn in high-viscosity material. In other embodiments, the footwear article 2 may also form part of a waterproof garment such as waders, for example.

As illustrated, the footwear article 2 may further include a vacuum release mechanism 16. The vacuum release mechanism 16 may include one or more check valves 18 disposed in one or more fluid passageways 20 formed in the sole 4 and/or the heel 14 of the footwear article 2. An entirety of the fluid passageways 20 may be formed in the sole 4 and/or heel 14 of the footwear article 2. In some embodiments, the fluid passageways 20 may be formed at an angle through the sole 4 and/or the heel 14. The fluid passageways 20 form flow paths through the sole 4 and/or heel 14 of the footwear article 2 and fluidly connect the interior 12 of the footwear article 2 to an exterior environment. Although the flow paths depicted are generally linear flow paths, it is understood that each of the flow paths formed by the fluid passageways 20 may have any shape, size, and configuration as desired.

FIG. 17 is a section view of a footwear article having a vacuum release mechanism according to another embodiment of the present disclosure. Each of the fluid passageways 20 may be separate and fluidly disconnected from one another as more clearly shown in FIG. 3. It is understood, however, that in certain embodiments, at least two of the fluid passageways 20 may be fluidly connected within the sole 4 and/or the heel 14 of the footwear article 2. End openings 22 of the fluid passageways 20 may be formed in a face 24 of the heel 14 of the footwear article 2. Such location is advantageous to keep the end openings 22, the check valves 18, and the fluid passageways 20 free of undesired material and debris that may cause blockage thereof. In certain embodiments, the end openings 22 may be formed at an angle to the outsole 10 of the footwear article 2, and more particularly, the end openings 22 may be oblique to the outsole 10. Opposing end openings 26 of the fluid passageways 20 may be relatively coplanar with an interior surface of the insole 8 of the footwear article 2. In some embodiments, the fluid passageways 20, and more particularly the end openings 26 thereof, may be fluidly connected to a tube having an end open to the exterior environment.

In the embodiment shown in FIGS. 6-11, each of the check valves 18 may be disposed into a respective one of the fluid passageways 20. The check valves 18 may be retained in the fluid passageways 20 by one of an interference fit, a threaded engagement, and at least one retaining element. It is understood that the check valves 18 may be any type of check valves as desired such as a piston-type check valve, a ball-type check valve, a diaphragm-type check valve, a swing-type check valve, a spring-type check valve, and a duckbill-type check valve, for example. The check valves 18 may be replaceable if desired. A substantially fluid tight seal is formed between the check valves 18 and an inner surface 28 of the fluid passageways 20. In some embodiments, the sole 4 and/or heel 14 of the footwear article 2 is produced from a self-sealing material (e.g., rubber, silicone) that forms a substantially fluid-tight seal between the check valves 18 and the inner surface 28 of the fluid passageways 20. In other embodiments, a sealing element may be disposed between the check valves 18 and the inner surface 28 of the fluid passageways 20 to form a substantially fluid-tight seal therebetween.

Figure 14:
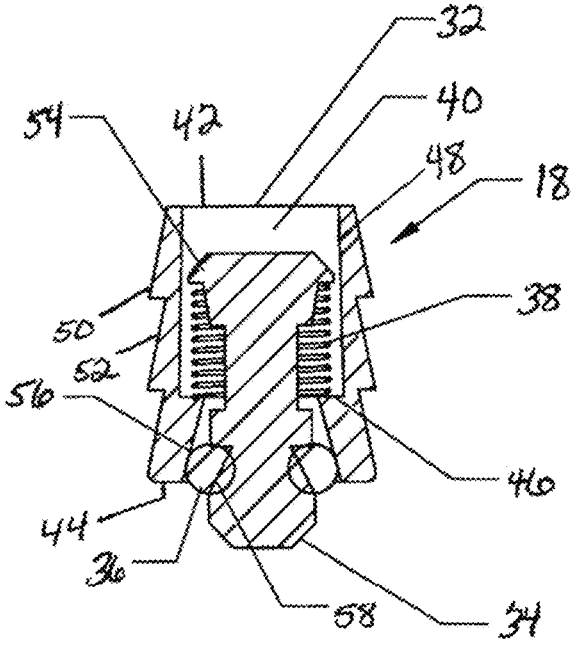
FIG. 14 is a cross-sectional view of the check valve of FIGS. 12 and 13 taken along section line 14-14 of FIG. 13, wherein the check valve is depicted in a closed or first position.
Figure 15:
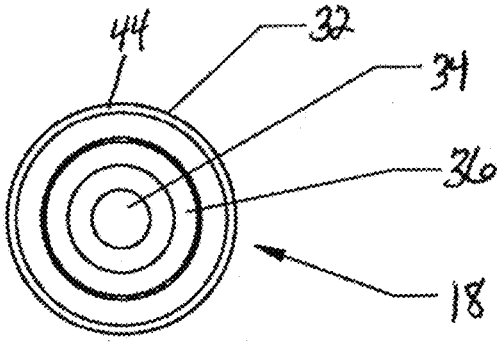
FIG. 15 is a bottom plan view of the check valve of FIGS. 12-14.
Figure 16:
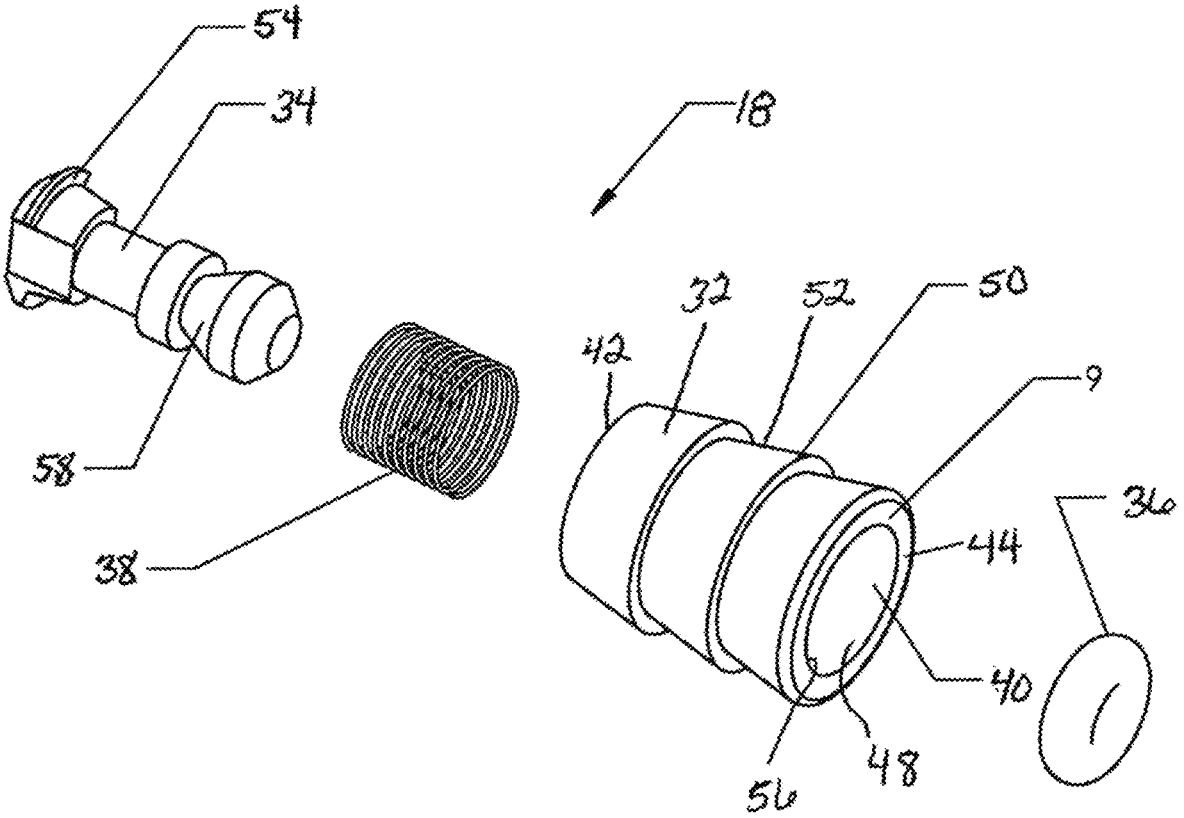
FIG. 16 is an exploded side perspective view of the check valve of FIGS. 12-15.

An exemplary embodiment of one of the check valves 18 is shown in FIGS. 12-16. The check valve 18 comprises a valve body 32, a movable valve piston 34, a sealing element 36 (e.g., an O-ring), and a biasing element 38 (e.g., a helical spring). As depicted, the valve body 32 may have a generally cylindrical shape with a bore 40 formed therethrough from a first end 42 to a second end 44 of the valve body 32. A seat 46 may be formed on an inner surface 48 of the valve body 32 to perform as a stop for the biasing element 38. One or more barbs 50 may be integrally formed on an outer surface 52 of the valve body 32 to engage the inner surface 28 of the fluid passageway 20 to maintain a position of the check valve 18 therein. The biasing element 38 is biased between a retainer portion 54 of the valve piston 34 and the seat 46 of the valve body 32. The biasing element 38 positions the valve piston 34 in a closed first position, as shown in FIG. 14, causing the sealing element 36 to seal against a valve body sealing surface 56 and a valve piston sealing surface 58. The check valves 18 in the first position militates against a flow of fluid therethrough when the footwear article 2 is unrestrained As a vacuum is created in a low pressure region under the footwear article 2 adjacent the end openings 22 of the check valves 18, a fluid from a high atmospheric pressure region within the interior 12 of the footwear article 2 overcomes a force of the biasing element 38 and urges the valve piston 34 away from the first end 42 and towards the second end 44 thereof so that the check valve 18 is in an open second position. When the check valve 18 is in the second position, the sealing element 36 is no longer sealing engaged with at least one of the valve body sealing surface 56 and the valve piston sealing surface 58 and thereby permits the flow of fluid therethrough when the footwear article 2 is restrained by a vacuum. Thus, pressure may be equalized across the check valve 18.

Figure 10:
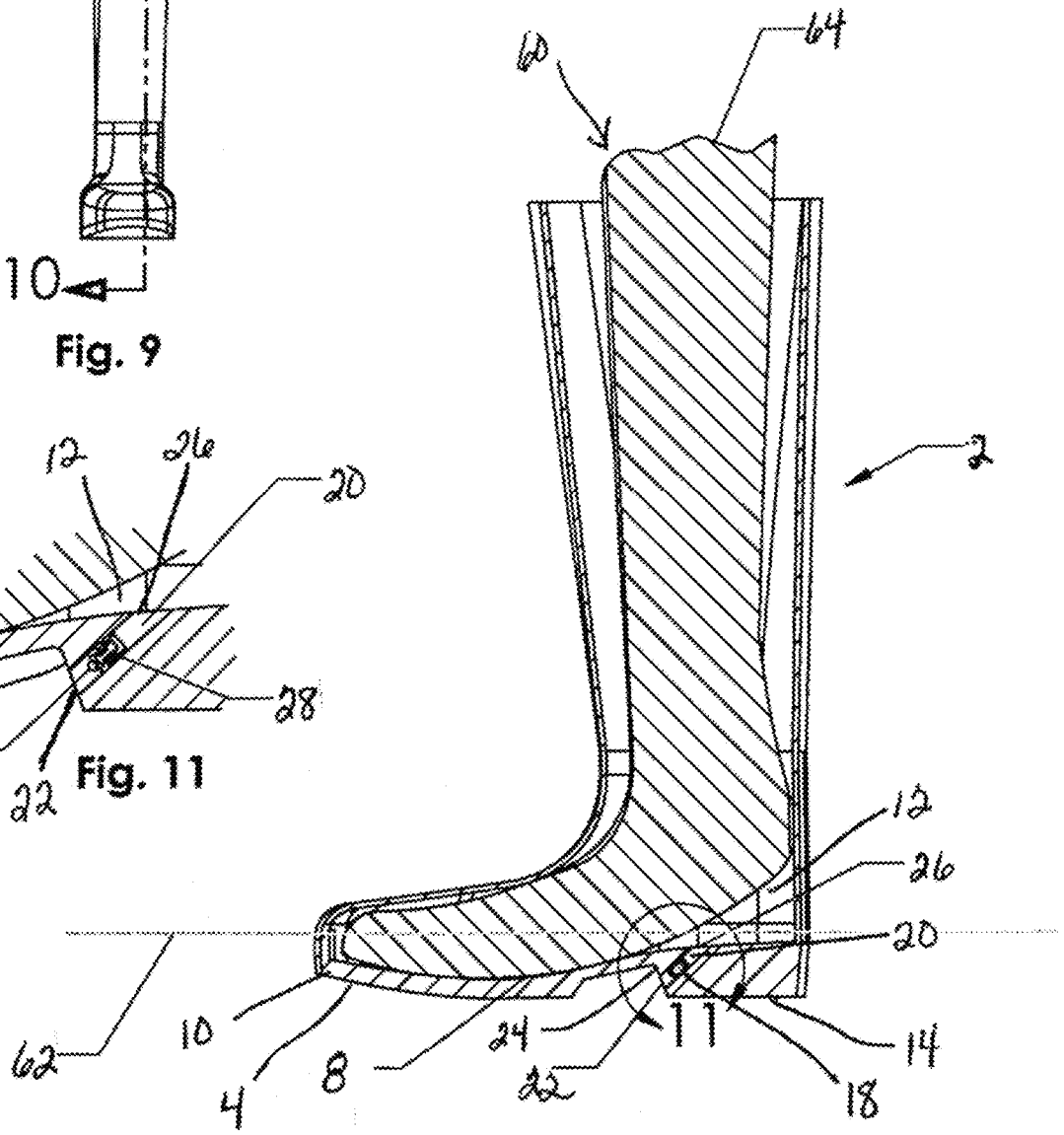
FIG. 10 is a fragmentary section view of the footwear article of FIGS. 1-9 taken along section line 10-10 of FIG. 9, wherein the lower limb portion of the wearer is disposed in the footwear article and the lower limb portion is in the second position.
Figure 12:
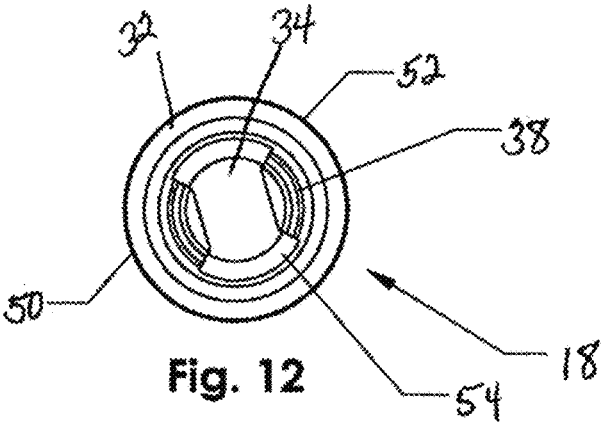
FIG. 12 is a top plan view of a check valve of the vacuum release mechanism of the footwear article of FIGS. 1-11.
Figure 13:
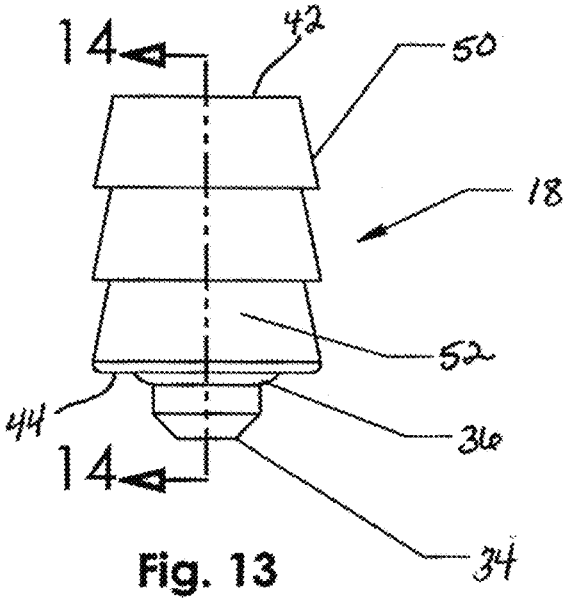
FIG. 13 is a side elevational view of the check valve of FIG. 12.

As a wearer 60 (depicted in FIGS. 8 and 10) takes a step and the footwear article 2 is placed in a viscous material at an approximate fluid level 62 relative to footwear article 2, a vacuum is created under the footwear article 2, causing resistance to a leg 64 of the wearer 60. As the wearer 60 lifts the leg 64 to take another step, the vacuum would typically not allow the footwear article 2 to be easily pulled from the viscous material. However, the vacuum release mechanism 16 of the footwear article 2 allows the footwear article 2 to be easily removed from the viscous material. In particular, the check valves 18 allow the fluid from the high atmospheric pressure region within the interior 12 of the footwear article 2 to flow through the fluid passageways 20 to the low atmospheric pressure region under the sole 4 and/or the heel 14 to equalize the pressure difference therebetween and thereby eliminate the vacuum created in the low atmospheric pressure region. Referring to FIG. 10, as the wearer 60 takes a step, the leg 64 is lifted to allow the end openings 26 of the fluid passageways 20 enough space for the fluid at atmospheric air pressure to reach the end openings 24 of the fluid passageways 20, thereby eliminating the low pressure region creating the vacuum under the sole 4 and/or the heel 14 of the footwear article 2.

Example embodiments are provided so that this disclosure will be thorough, and willfully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions and methods can be made within the scope of the present technology, with substantially similar result.

ITEM LIST

2 Footwear article
4 Sole
6 Upper
8 Insole
10 Outsole
12 Interior
14 Heel
16 Vacuum release mechanism
18 Check valves
20 Fluid passageways
22 End openings of fluid passageways
24 Face of heel
26 End openings of fluid passageways
28 Inner surface of fluid passageway
32 Valve body
34 Valve piston
36 Sealing element
38 Biasing element
40 Bore of valve body
42 First end of valve body
44 Second end valve body
46 Seat of valve body
48 Inner surface of valve body
50 Barb of valve body
52 Outer surface of valve body
54 Retainer portion of valve piston
56 Valve body sealing surface
58 Valve piston sealing surface
60 Wearer
62 Approximate fluid level
64 Leg of wearer

What is claimed is:

1. A footwear article, comprising:

a sole including an insole, an outsole, and a heel having a side face, wherein the side face of the heel intersects and is formed at an angle relative to an outer contact surface of the outsole;

an upper coupled to the sole, wherein the insole and the upper defines an interior of the footwear article;

at least one passageway formed in the sole, the at least one passageway fluidly connects an exterior environment with the interior of the footwear article, wherein a first end opening of the at least one passageway is formed in the side face of the heel and a second end opening of the at least one passageway is formed in the insole; and a vacuum release mechanism disposed in the at least one passageway of the sole, the vacuum release mechanism comprising:

at least one check valve disposed in the at least one fluid passageway formed in the sole of the footwear article, wherein the at least one check valve is a spring-type check valve, the spring-type check valve comprises a valve body, a movable valve piston, a sealing element, and a biasing element, wherein the biasing element positions the movable valve piston in a closed position to seal against a valve body sealing surface and a valve piston sealing surface, and wherein the at least one check valve in a first position militates against a flow of fluid through the at least one passageway of the sole.

2. The footwear article of claim 1, wherein the footwear article forms part of a waterproof garment.

3. The footwear article of claim 1, wherein an entirety of the at least one fluid passageway is formed in the sole of the footwear article.

4. The footwear article of claim 1, wherein the at least one fluid passageway is formed at an angle through the sole of the footwear article.

5. The footwear article of claim 1, wherein a plurality of check valves is disposed in a plurality of fluid passageways formed in the sole of the footwear article, and wherein each of the fluid passageways is separate and fluidly disconnected from one another.

6. The footwear article of claim 1, wherein a plurality of check valves is disposed in a plurality of fluid passageways formed in the sole of the footwear article, and wherein at least two of the fluid passageways are fluidly connected to one another.

7. The footwear article of claim 1, wherein the at least one fluid passageway forms a linear flow path through the sole of the footwear article.

8. The footwear article of claim 1, wherein the first end opening of the at least fluid passageway is oblique to the outsole of the footwear article.

9. The footwear article of claim 1, wherein the second end opening of the at least one fluid passage way is relatively coplanar with an interior surface of the insole of the footwear article.

10. The footwear article of claim 1, wherein the at least one check valve in the first position militates against a flow of fluid therethrough when the footwear article is unrestrained, and wherein the at least one check valve in a second position permits the flow of fluid therethrough when the footwear article is restrained by a vacuum.

11. The footwear article of claim 1, wherein the at least one check valve is retained in the at least one fluid passageway by one of an interference fit, a threaded engagement, and at least one retaining element.

12. The footwear article of claim 1, wherein a substantially fluid tight seal is formed between the at least one check valve and an inner surface of the at least one fluid passageway.

13. The footwear article of claim 1, wherein the sole of the footwear article is produced from a self-sealing material that forms a substantially fluid-tight seal between the at least one check valve and an inner surface of the at least one fluid passageway.

14. The footwear article of claim 1, further comprising a sealing element to form a substantially fluid-tight seal between the at least one check valve and an inner surface of the at least one fluid passageway.

15. The footwear article of claim 1, wherein the at least one check valve is replaceable.

16. A footwear article, comprising:

a sole including an insole, an outsole, and a heel having a side face, wherein the side face of the heel intersects and is formed at an angle relative to an outer contact surface of the outsole;

an upper coupled to the sole, wherein the insole and the upper defines an interior of the footwear article;

at least one passageway formed in the sole, the at least one passageway fluidly connects an exterior environment with the interior of the footwear article, wherein a first end opening of the at least one passageway is formed in the side face of the heel and a second end opening of the at least one passageway is formed in the insole; and a vacuum release mechanism disposed in the at least one passageway of the sole, the vacuum release mechanism comprising:

at least one check valve disposed between the end openings of the at least one fluid passageway, wherein the at least one check valve is a spring-type check valve, the spring-type check valve comprises a valve body including an outer surface provided with one or more barbs, a movable valve piston disposed in the valve body, a sealing element disposed on the movable valve piston, and a biasing element biased between a retainer portion of the movable valve piston and a seat formed on the valve body, wherein the one or more barbs engage an inner surface of the at least on passageway to secure the at least one check valve therein, wherein the biasing element positions the movable valve piston in a closed position, and wherein the at least one check valve in a first position militates against a flow of fluid therethrough and in a second positon permits the flow of fluid therethrough.

17. A footwear article, comprising:

a sole including an insole, an outsole, and a heel having a side face, wherein the side face of the heel intersects and is formed at an angle relative to an outer contact surface of the outsole;

an upper coupled to the sole, wherein the insole and the upper defines an interior of the footwear article;

at least one passageway formed in the sole, the at least one passageway fluidly connects an exterior environment with the interior of the footwear article, wherein a first end opening of the at least one passageway is formed in the side face of the heel and a second end opening of the at least one passageway is formed in the insole; and a vacuum release mechanism disposed in the at least one passageway of the sole, the vacuum release mechanism comprising:

at least one check valve disposed in the at least one fluid passageway of the sole, wherein an entirety of the at least one check valve is accessible from the exterior environment and replaceable, wherein the at least one check valve is a spring-type check valve, the spring-type check valve comprises a valve body, a movable valve piston, a sealing element, and a biasing element, wherein the biasing element positions the movable valve piston in a closed position to seal against a valve body sealing surface and a valve piston sealing surface, wherein the at least one check valve in a first position militates against a flow of fluid therethrough and in a second positon permits the flow of fluid therethrough, and wherein the entirety of the at least once check valve is contained in the at least on passageway when both the first positon and second position.

* * * * *